US008660289B2

(12) United States Patent
Tiscareno

(10) Patent No.: US 8,660,289 B2
(45) Date of Patent: Feb. 25, 2014

(54) MULTIPLE RECEIVER VENTING SYSTEM

(75) Inventor: Victor M. Tiscareno, Issaquah, WA (US)

(73) Assignee: Apple Inc., Cupertino, CA (US)

( * ) Notice: Subject to any disclaimer, the term of this patent is extended or adjusted under 35 U.S.C. 154(b) by 1429 days.

(21) Appl. No.: 12/040,616

(22) Filed: Feb. 29, 2008

(65) Prior Publication Data

US 2009/0220113 A1 Sep. 3, 2009

(51) Int. Cl.
*H04R 25/00* (2006.01)

(52) U.S. Cl.
USPC ..... 381/380; 381/328

(58) Field of Classification Search
USPC ..... 381/186, 335, 312, 328, 330
See application file for complete search history.

(56) References Cited

U.S. PATENT DOCUMENTS

| | | | | |
|---|---|---|---|---|
| 5,960,093 | A | 9/1999 | Miller | |
| 6,654,477 | B1 | 11/2003 | Miller et al. | |
| 2008/0063223 | A1 * | 3/2008 | van Halteren et al. | 381/182 |
| 2008/0181443 | A1 * | 7/2008 | Harvey et al. | 381/380 |

OTHER PUBLICATIONS

Knowles Electronics, Itasca, Illinois, USA, EC Series Receiver Specification, Nov. 18, 2005, (3 page).

"Why does your speaker have a hole in it? Is there something inside trying to get out?", Record-Producer.com, Dec. 20, 2007, Internet article at: http://www.record-producer.com/learn.cfm?a=92, (4 pages).

Miller, Colin , "Essay: "How a Hole-in-the-Box Works—A Big Dig into Bass Reflex"", Jun. 1998 (Updated Mar. 2001), Secrets of Home Theater and High Fidelity, Dec. 20, 2007, Internet article at: http://www.hometheaterhifi.com/volume_5_2/cmilleressayporting.html, (10 pages).

* cited by examiner

*Primary Examiner* — Brian Ensey

(74) *Attorney, Agent, or Firm* — Blakely, Sokoloff, Taylor & Zafman LLP

(57) ABSTRACT

An earphone housing has a sound output port to be inserted into an ear. Multiple drivers are located in the housing. Each driver has a respective motor and a respective diaphragm. The diaphragm of one of the drivers is vented but that another is not. Other embodiments are also described and claimed.

30 Claims, 6 Drawing Sheets

MULTIPLE RECEIVER VENTING SYSTEM

This invention relates generally to headphones and in particular to in-ear earphones. Other embodiments are also described.

BACKGROUND

Whether listening to an MP3 player while traveling, or to a hi-fi stereo system at home, consumers are increasingly choosing the in-ear earphone for their listening pleasure. Although these acoustic devices have a relatively low profile, which provides convenience, they are also able to provide good sound quality. An in-ear earphone, also referred to as an earbud, is designed to be inserted partially into an ear canal so as to create an airtight seal against the inner surface of the canal. This provides the wearer with good acoustic isolation against external sounds. However, if the wearer were to ride up in an elevator while listening to the earphone, the resulting sudden drop in outside (barometric) pressure may cause the in-ear phone to stop playing. This may be explained as follows.

Consider a typical in-ear earphone that has a receiver case in which a motor is connected to a diaphragm. Note the reference to "receiver" here, which is a type of driver that is designed to be small enough and have the appropriate sound pressure output levels for use in an earphone. An electrical audio signal that is applied to the motor causes the diaphragm to move and thereby create sound pressure, which is directed out of a main sound output port of the earphone (and into the user's ear). The diaphragm has one side (inside the receiver case) that is open to the main sound port, and another that seals the receiver case airtight. When the barometric pressure drops, the air pressure inside the receiver case against the side of the diaphragm that is open to the sound port will also drop, due to "gasket leakage" past the seal made with the ear canal. However the pressure on the sealed side of the diaphragm does not equalize as quickly, thereby causing the diaphragm to "stick" so that no sound is being produced. To avoid this undesirable effect, the diaphragm is manufactured with a calibrated airflow hole, also referred to as a barometric vent hole. The hole is sized to allow the pressures on both sides of the diaphragm to equalize quickly, so as to reduce the likelihood that the diaphragm will be held stuck in the event of a sudden barometric pressure change. But the hole will adversely affect the acoustic response of the receiver and cause the sound output capability to drop somewhat. On balance however, the performance reduction caused by the hole has been tolerated given its beneficial effect on the overall practicality of the earphone.

SUMMARY

An embodiment of the invention is an earphone whose housing has a sound output port to be inserted into an ear. There are at least two drivers located in the housing. Each of the drivers has a respective motor and a respective diaphragm. The diaphragm one driver is vented but that of the other is not. Closing the hole in the diaphragm of the latter driver increases its efficiency to achieve more sound output. Small drivers or receivers that fit within an earphone housing are typically not known to provide significant bass output. Thus, by dosing the hole in the diaphragm of a woofer, for example, an embodiment of the invention may improve woofer output in such a multiple receiver system.

In another embodiment, the earphone has at least two receivers that may be essentially identical physically, and that acoustically reinforce each other while being operated in parallel over a relatively wide frequency range. One of the receivers is "burdened" with the duty of barometric venting (its diaphragm is vented), but the other is not. This allows the latter's sound output or efficiency to increase relative to that of the other (within their frequency and/or sound pressure level range of operation). Such a technique may be used to enhance bass boost, or contour the bass performance, of the earphone as a whole. Other embodiments are also described.

The above summary does not include an exhaustive list of all aspects of the present invention. Indeed, the inventor contemplates that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

The embodiments of the invention are illustrated by way of example and not by way of limitation in the figures of the accompanying drawings in which like references indicate similar elements. It should be noted that references to "an" or "one" embodiment of the invention in this disclosure are not necessarily to the same embodiment, and they mean at least one.

DETAILED DESCRIPTION

In this section we shall explain several preferred embodiments of this invention with reference to the appended drawings. Whenever the shapes, relative positions and other aspects of the parts described in the embodiments are not clearly defined, the scope of the invention is not limited only to the parts shown, which are meant merely for the purpose of illustration.

Figure 1:
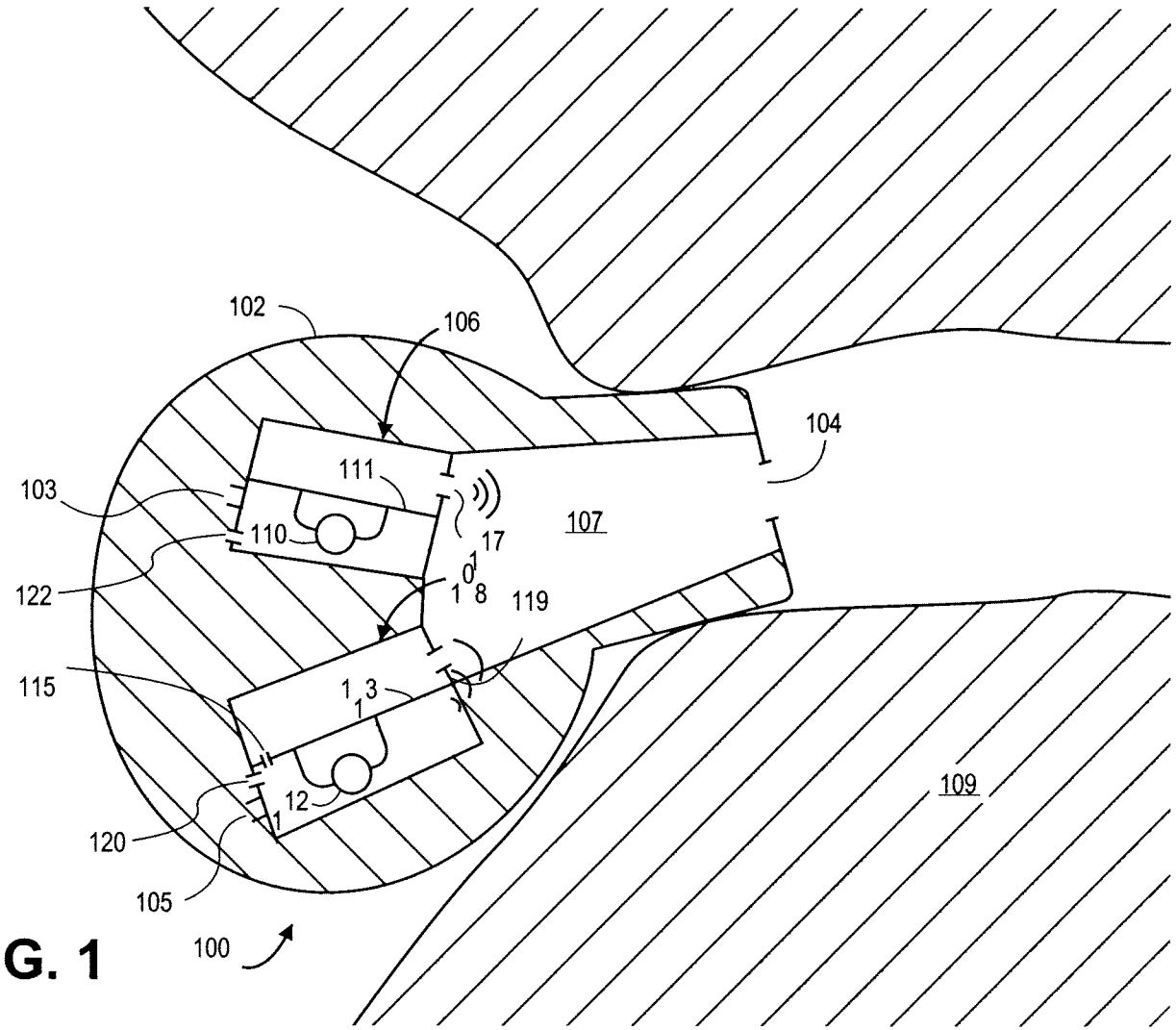
FIG. 1 is a diagram of an earphone with a multiple receiver venting system.

FIG. 1 is a diagram of an earphone 100 with a multiple receiver venting system, in accordance with an embodiment of the invention. The in-ear earphone 100 has an earphone or earplug housing 102 with a housing sound output port 104, formed in its far end portion as shown. The port 104 is inserted into an ear 109. Multiple drivers, including at least a first driver 106 and a second driver 108 are located or contained in a near end portion of the housing 102. Each driver 108, 106 has a respective motor 112, 110 that drives a respective diaphragm 113, 111 in response to an input or incoming electrical audio signal at its respective electrical audio input port 103, 105. Each driver-diaphragm pair is tuned for its respective frequency range of operation. The drivers 106, 108 may be part of a pair of essentially identical, wide band output receivers. As an alternative, the driver 106 may be a low frequency driver, while the driver 108 is a high frequency driver.

Each driver converts its input electrical signal through actuation of its diaphragm by way of its motor, into sound pressure waves. These are guided through the respective sound output port 119, 117, in this case into the chamber 107 inside the housing and then onward through the housing sound output port 104. The drivers 106, 108 may be fixed in position relative to and inside the housing 102. The orientation of the drivers 106, 108, the shape of the chamber 107 and the shape and materials of its interior walls and passages should be designed to promote the quality of sound heard by the wearer of the earphone 100. The sound pressure waves are delivered through housing output port 104 into the wearer's ear 109 and onward through the ear canal and onto the wearer's ear drum (not shown).

The venting system assists in providing barometric relief to the earphone in FIG. 1, while the earphone is being worn, by equalizing the pressure on both sides of each diaphragm, as follows. First, consider the following definitions, which are merely used for purposes of distinguishing between two sides. The "front" side of each of the diaphragms 111, 113 in this case is facing or is open to the respective driver sound output port 117, 119. The "back" side is facing the respective motor 110, 112. In one embodiment, the drivers and the housing may be constructed so that the space directly behind each of the diaphragms 111, 113 are vented to each other, but not necessarily to the atmosphere. If pressure on the front side of the diaphragm 113 drops suddenly due to barometric change, it will also drop in a similar manner on its back side, due to the vent hole 115. Similarly, pressure on both sides of the other diaphragm 111 will need to be equalized quickly to ensure uninterrupted operation of the earphone. This effect may be explained as follows.

The diaphragm 113 has a barometric vent hole 115 therein, which allows it to maintain a better range of motion even during periods of sudden barometric pressure changes, while the earphone 100 is being worn. The vent hole 115 is a relatively small hole that should be engineered or tuned to provide sufficiently rapid relief from abrupt atmospheric or barometric pressure changes, e.g. such as those that occur when the wearer is flying in an airplane that is changing altitude or riding in a moving elevator, while not losing too much performance or efficiency from the driver 108. The vent hole 115 serves to equalize the pressure on the front side and back side of the diaphragm 113, during such barometric pressure changes. The airflow required is relatively small and may be similar to that of gasket leakage. The hole may be created in the diaphragm through a calibrated piercing operation (e.g., using a laser beam) that precisely controls the size of the opening. At the same time, however, the diaphragm 111 of the other driver is intact in that it does not have a hole that would typically provide similar pressure equalization.

Referring now to the driver 108, its diaphragm 113 may be viewed as essentially splitting an interior space within the housing 102 into at least two portions—sound port 119 opens into a front portion, while a rear portion opens to a vent hole 120. As described below in connection with FIG. 3, the vent hole 120 may be formed in a wall of a case 308 that houses the motor and diaphragm components of the driver 108. The vent hole 120 need not be tuned other than to provide sufficient airflow for venting purposes, e.g. it may be at least as large as the vent hole 115 in the diaphragm 113.

Referring now to the driver 106, its diaphragm 111 may be viewed as essentially splitting an interior space within the housing 102 into at least two portions—a front portion into which the sound port 117 opens, and a rear portion. The rear portion opens to a vent hole 122. This vent hole, as described below in connection with FIG. 3, may be formed in the wall of a case 306 that houses the motor and diaphragm components of the driver 106.

Figure 3:
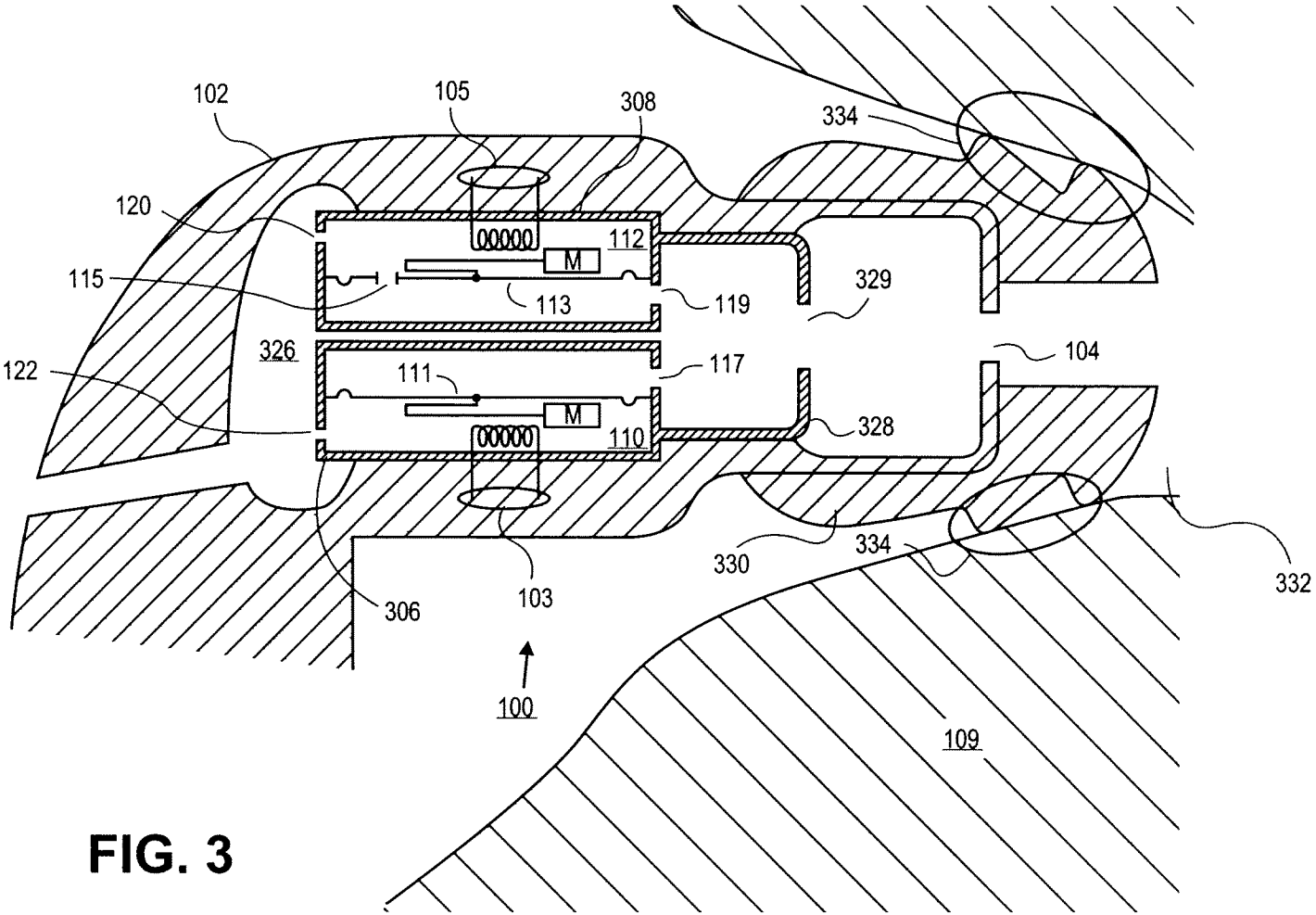
FIG. 3 is a diagram of another earphone with a multiple receiver venting system.

Although not explicitly shown in FIG. 1, to assist in barometric relief, the vent holes 120, 122 are connected to each other by one or more air or vent paths within the housing 102, which may or may not be also open to the atmosphere. For example, there may be separate outside bores formed in the housing that allow air flow to the vent holes 120, 122, respectively, from outside the housing 102. An alternative to this is shown in FIG. 3 described below, where a single outside bore formed in the housing is shared by the two vent holes 120, 122. In both cases, an effective vent path within the housing 102 allows the diaphragm 111 to, despite being essentially intact, still maintain its full range of motion during barometric pressure changes. This may be explained as follows. Air pressure on both sides of the diaphragm 111 may equalize through the following vent path sequence: sound output port 117, sound output port 119, vent hole 115, vent hole 120, and vent hole 122. Hence, there may be no need for venting the diaphragm 111 of the driver 106, thereby improving its efficiency. This improvement in efficiency may be particularly desirable when the driver 106 is a relatively small, low frequency driver such as that used in a woofer receiver.

Figure 2:
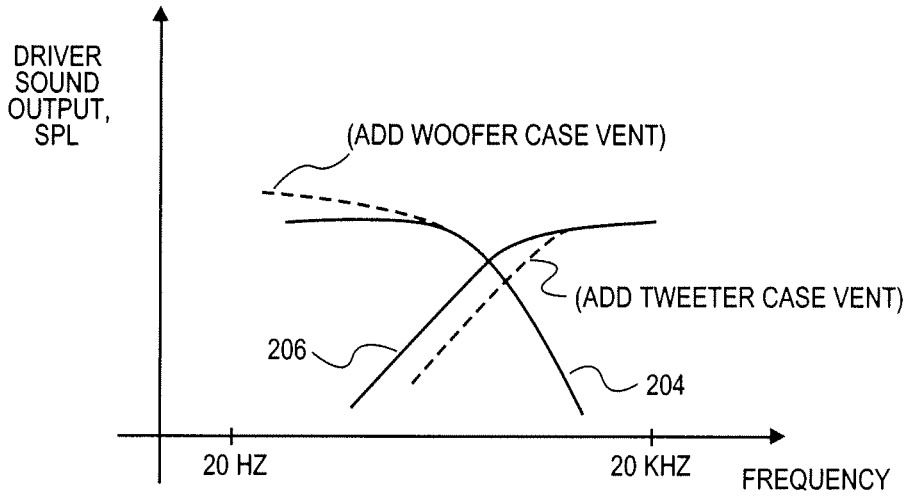
FIG. 2 shows driver frequency response curves.

In one embodiment, the driver 106 is a low frequency driver, while the driver 108 is a high frequency driver. The terms "low" and "high" here are used not in their absolute sense but merely relative to each other. Examples of tuned low frequency and high frequency drivers include: at least one woofer and one tweeter; at least one woofer and one midrange; at least one midrange and one tweeter; or another combination of at least one tuned low frequency driver and at least one tuned high frequency driver. FIG. 2 shows frequency response curves for a pair of example low and high drivers. The output sound pressure level (SPL) of the low driver (response curve 204) is relatively flat at lower frequencies and then rolls off at higher frequencies, while that of the high driver (response curve 206) is relatively flat at higher frequencies and then rolls off at the lower frequencies. There is a point at which the two curves 204, 206 cross over. The actual flatness of the curves 204, 206 and their roll off characteristics may be somewhat different than that shown.

Turning now to FIG. 3, this is a diagram of the earphone 100 with a multiple receiver venting system, in accordance with an embodiment of the invention. The housing 102 contains a receiver case 308 in which the motor 112 and its associated diaphragm 113 are located or contained—these may be tuned to perform as a high frequency driver, for example. The sound output port 119 is formed in a front wall of the case 308 and is acoustically coupled to the front side of the diaphragm 113. The diaphragm 113 may be viewed as essentially splitting an interior space of the case 308 into at least two portions—sound port 119 opens into a front portion, while a rear portion opens to the vent hole 120 that in this case is formed in a wall of the case 308. This vent hole 120 need not be tuned other than to provide sufficient airflow for venting purposes, e.g. it may be at least as large as the vent hole 115 in the diaphragm 113. FIG. 2 shows an effect on the response of a high frequency driver, by adding the vent hole 120, namely a slight reduction in its low frequency response. The case 308 may be essentially sealed or airtight for acoustic purposes, but for the vent hole 320 and the output port 119.

Also contained in the housing 102 is a further receiver case 306 in which the motor 110 and diaphragm 111 are located. These may be tuned to perform as a low frequency driver, for example. The sound output port 117 is formed in a front wall of the case 306 as shown, and is acoustically coupled to the front side of the diaphragm 111. The diaphragm 111 may be viewed as essentially splitting an interior space of the case 306 into at least two portions, a front portion into which the sound port 117 opens, and a rear portion. The rear portion opens to the vent hole 122 formed, in this case, in the wall of the case 306. FIG. 2 shows an effect on the response of a low frequency driver, by adding the vent hole 122, namely a slight increase in its low frequency response. The vent hole 122 should be engineered or tuned to provide its driver with the desired acoustical efficiency, in addition to its venting duties. The case 306 may be essentially sealed or airtight for acoustic purposes, but for the vent hole 122 and the output port 117.

The vent holes 120, 122 are connected to each other by one or more air or vent paths within the housing, which may or may not be open to the atmosphere. In this case, FIG. 3 shows the vent holes 120, 122 opening into a common cavity 326 inside the housing 102, which is vented to the atmosphere through a single bore as shown. Other ways of providing air flow to the atmosphere, from both vent holes 120, 122 and through the housing 102, are possible. Adding this "housing vent" or "enclosure vent", to vent the housing of the earphone 100 to the atmosphere, may yield an improved human perspective on the sound produced by the worn earphone 100, during sudden barometric pressure changes.

Still referring to FIG. 3, in this embodiment, the sound pressure waves that emanate from the output ports 117, 119 of the receiver cases are concentrated or combined by a common spout or funnel 328 and guided out through its common output port 329 as shown. This structure surrounds the output ports 117, 119. In this case, it extends from an outside surface of the front wall of the case 308 (that in part surrounds the sound output port 119), and from an outside surface of the front wall of the case 306 (that in part surrounds the sound output port 117). Alternatives to the spout 329 include other structures that can concentrate or combine the sound pressure waves from multiple receivers and guide them through a common sound output port 329.

The combined sound output of the multiple receivers, delivered through the port 329 of the spout 328, is further guided by the chamber 107, to the housing sound output port 104 at the far end portion of the housing 102. In this case, an ear tip or cap 330 has been fitted to the far end portion of the housing as shown. The tip 330 may be made of a flexible material such as silicone or gel material. It is shaped and sized as shown to allow the wearer to squeeze its outside surface while inserting into the ear 109, and then the ear canal 332, to thereby make an airtight seal all around the outside surface 334 which is in contact with the surface of the ear canal 332. Multiple tips 330 each of a different outer diameter and/or of a different outer surface shape can be supplied for a single earphone, to suit different types of ears.

There are several variations possible for the arrangement of FIG. 3. For instance, the cases 306, 308 may be made of metal or other suitable acoustically isolating materials used for small receiver cases. The housing 102 may be made of a lightweight plastic for example, or other suitable materials conventionally used for earphone housings. Also, one or both of the motors 110, 112 may have a coil and magnet that has a balanced magnetic structure, also referred to as a balanced armature, to obtain a more linear diaphragm response.

Figure 6:
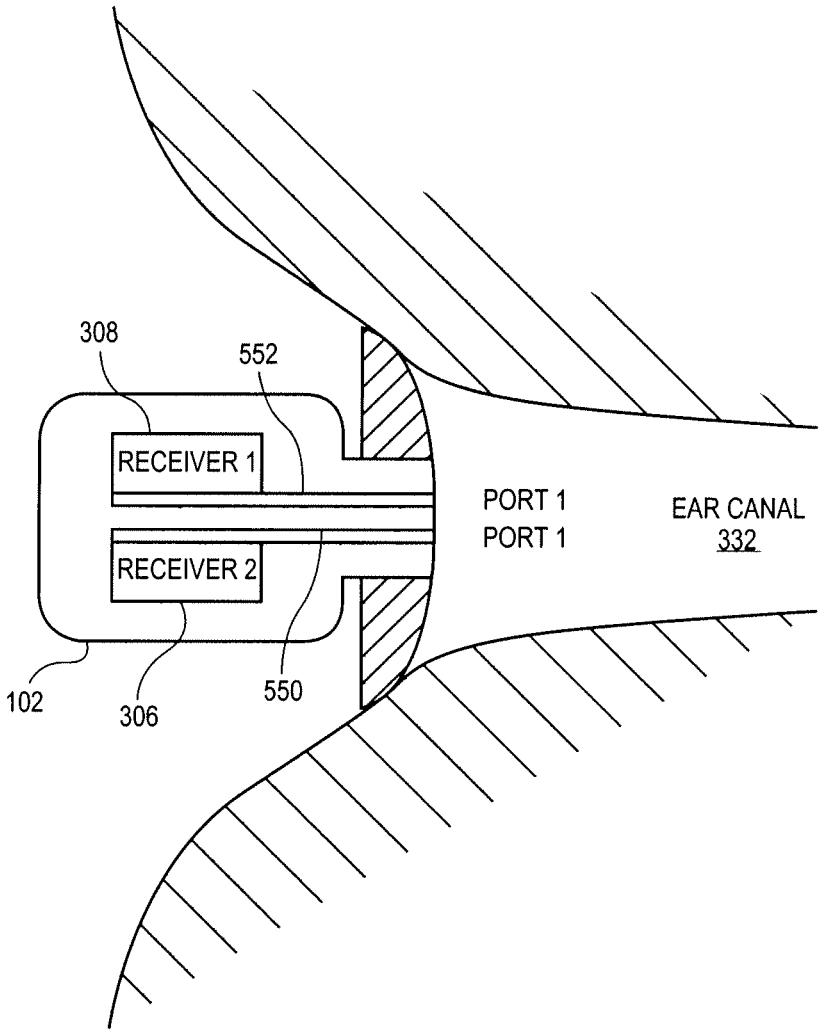
FIG. 6 is a diagram of an earphone with elongated port receivers.

In another embodiment, depicted in FIG. 6, the earphone has no spout 329 for concentrating the sound from multiple receivers. In this case, each of the at least two receiver cases 306, 308 (that are located within the housing 102) has an elongated, respective or discrete sound output port 550, 552 that extends all the way to the far end portion of the earphone, reaching or extending into the ear canal as shown (where the earphone is being worn).

Figure 4:
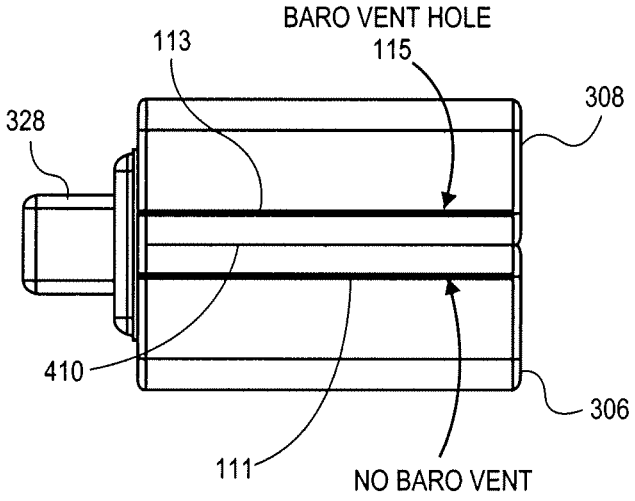
FIG. 4 is a diagram of a pair of receivers joined as a unit.

Referring now to FIG. 4, this diagram shows a pair of receivers that have been joined to each other as a unit, and have a venting system in accordance with an embodiment of the invention (the vents 120, 122 which may be formed in the case walls—see FIG. 3—are not shown). In this embodiment, a lengthwise wall or side wall of the case 306 (of the low frequency receiver or driver), is joined to a lengthwise wall or side wall of the case 308 (of the high frequency receiver or driver). This may be done using a conventional bonding process, e.g. a metal welding process. The cases 306, 308 are oriented so that the front sides of their respective diaphragms 111, 113 (which open to the respective sound output ports 117, 119) face each other as shown. The common spout 328 may be a separately manufactured piece. The spout or funnel 328 may have a wider opening at its near end portion, which is connected to its smaller opening at its far end portion, by a tube (as shown for example in FIG. 3 and in FIG. 4). The near end portion (containing the wider opening) in this case has been joined to the outside surface of the front walls of the joined cases, surrounding and sealing off the two sound output ports 117, 119 (see, e.g. FIG. 3). This combination of joined receiver cases 306, 308 and spout 328 may then be sold as a single unit, to for instance be placed into the housing 102 of an earphone 100.

Figure 5:
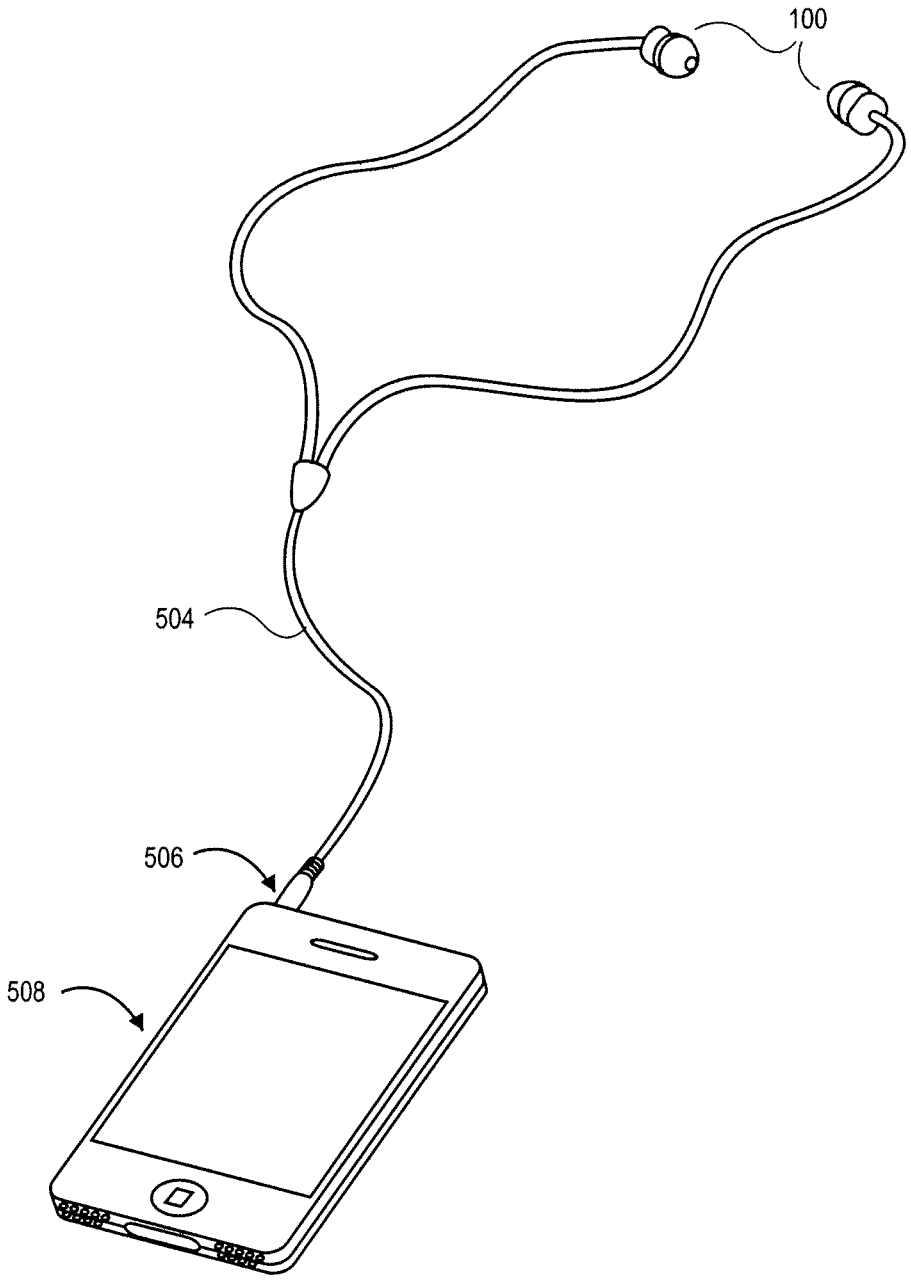
FIG. 5 shows a system application of an earphone.

The invention is not limited to the specific embodiments described above. For example, in contrast to a hearing aid which produces an electrical audio signal from a built-in pickup and then converts the electrical signal to sound waves, the driver in an earphone 100 (that is in accordance with an embodiment of the invention) receives its input electrical signal directly from an external amplifier. As depicted in FIG. 5, this may be via a cable 504 that is connected to a headphone output port 506 of an external, portable, consumer grade digital media storage and playback device 508 such as an IPOD player or an IPHONE communications device that is located nearby. As an alternative, the earphone may be integrated with a wireless interface to receive the electrical signal via a wireless connection with the external amplifier. In another aspect, the motors within the earphone may be connected in parallel. In addition, or as an alternative, a passive or active crossover circuit may be built into the housing or into the driver's case, to receive and filter the external electrical signal (prior to being input to a motor). Also, although the figures show only two drivers, there may be more than two drivers that are in the same earphone or that have been combined as a unit (and that may benefit from the venting system described above). For instance, there may be three receivers, namely a tweeter, a midrange and a woofer, that have been joined or combined as a unit. In that case, the tweeter diaphragm might be vented, but those of the midrange and woofer are not. Also, the space "behind" the diaphragms of all three receivers could be vented to each other via an internal vent path of the housing that is not open to the atmosphere. Accordingly, other embodiments are within the scope of the claims.

What is claimed is:

1. An in-ear earphone comprising:

an earphone housing having a sound output port at a far end portion, the sound output port to be inserted into an ear; and first and second drivers located in the housing, each of the drivers having a respective motor and a respective diaphragm, wherein the diaphragm of the second driver is vented but that of the first driver is not and sound waves generated by each of the drivers are guided to the sound output port through respective driver sound output ports facing the far end portion of the housing.

2. The earphone of claim 1 wherein the first driver is a low frequency driver and the second driver is a high frequency driver.

3. The earphone of claim 1 further comprising:

a first case in which the motor and diaphragm of the first driver are located, the first case having a respective sound output port; and a second case in which the motor and diaphragm of the second driver are located, the second case having a respective sound output port.

4. The earphone of claim 3 further comprising a spout that surrounds the respective sound output ports of the first and second cases.

5. The earphone of claim 1 further comprising:

a first case in which the motor and diaphragm of the first driver are located; and a second case in which the motor and diaphragm of the second driver are located, wherein each of the first and second cases has a respective vent hole in its wall, and wherein except for the respective vent holes and respective sound output ports, the first and second cases are each sealed or airtight.

6. The earphone of claim 5 wherein the first and second case vent holes are vented to each other through an internal air path in the housing that is not open to the atmosphere.

7. The earphone of claim 6 wherein the first driver is a woofer and the second driver is a tweeter.

8. The earphone of claim 6 wherein the first and second drivers are essentially identical and are connected to be operated in parallel.

9. The earphone of claim 5 wherein the first and second case vent holes are vented to each other through an internal air path in the housing that is open to the atmosphere.

10. The earphone of claim 1 further comprising a tip fitted to the housing around the sound output port, wherein the tip is made of a flexible material to obtain an airtight seal all around an outer surface of the tip against the outer surface of an ear canal when the earphone is inserted into the ear.

11. An in-ear earphone comprising:

an earphone housing having therein a chamber that is open to a sound output port formed in the housing to be inserted into an ear;

a woofer located in the housing; and a tweeter located in the housing, wherein a diaphragm of the tweeter is pierced for barometric relief, but that of the woofer is not and sound waves generated by the tweeter and the woofer are guided through the chamber to the sound output port of the housing, through respective output ports of the tweeter and woofer that face the sound output port.

12. The earphone of claim 11 wherein the woofer comprises a case having a sound output port and a vent hole formed in its wall, and the tweeter comprises a further case having a sound output port and a vent hole in its wall.

13. The earphone of claim 12 wherein the woofer case and the tweeter case are joined to each other so that a front side of the woofer diaphragm, which is open to the woofer case sound output port, faces a front side of the tweeter diaphragm, which is open to the tweeter case sound output port.

14. The earphone of claim 13 further comprising a common spout joined to the woofer and tweeter cases and that surrounds the woofer and tweeter sound output ports.

15. A sound apparatus comprising:

an earphone having therein a first driver case and a second driver case each having a respective diaphragm therein, the first and second driver cases being coupled to each other so that the respective diaphragms face each other, the respective diaphragm in the first driver case being pierced for barometric relief but the one in the second driver case being intact, and wherein the first driver case has a barometric vent in its wall that is sized large enough to meet venting requirements for both the first and second driver cases.

16. The apparatus of claim 15 wherein the first driver case is that of a tweeter, and the second driver case is that of a woofer.

17. The apparatus of claim 16 wherein the second driver case has a vent hole in its wall.

18. An electro-acoustic apparatus comprising:

a first receiver having a low frequency sound response, the first receiver having a first receiver case that has a first sound response opening therein and that contains a diaphragm having a barometric vent hole;

a second receiver having a high frequency sound response, the second receiver having a second receiver case that has a second sound response opening therein and that contains a diaphragm having no barometric vent hole, wherein the first receiver case is fixed relative to the second receiver case to form a unit.

19. The apparatus of claim 18 further comprising:

a spout extending from a) a surface of the first receiver case that in part surrounds the first sound response opening, and b) a surface of the second receiver cases that in part surrounds the second sound response opening.

20. The apparatus of claim 18 wherein the first and second receiver cases abut one another.

21. The apparatus of claim 20 wherein the first and second receiver cases abut one another along their respective lengthwise walls so that a front side of the diaphragm of the first receiver is facing a front side of the diaphragm of the second receiver.

22. The apparatus of claim 21 wherein the first and second sound response openings are formed in respective sidewalls of the first and second receiver cases.

23. The apparatus of claim 18 wherein the low frequency sound response is characteristic of a woofer, and the high frequency sound response is characteristic of a tweeter.

24. An in-ear earphone comprising:

an earphone housing having a sound output port at a far end portion, the sound output port to be inserted into an ear; and first and second drivers located in the housing, each of the drivers having a respective motor and a respective diaphragm, the respective diaphragm splits an interior space within the housing into a front portion and a rear portion, the rear portion opens to a respective vent hole, and wherein the diaphragm of the second driver is vented but that of the first driver is not and sound waves generated by each of the drivers are guided to the sound output port through respective driver sound output ports facing the far end portion of the housing.

25. The earphone of claim 24 wherein the respective vent hole of each of the first and second drivers is connected to the other by an internal air path within the earphone housing.

26. The earphone of claim 24 wherein the first driver is a low frequency driver, and the second driver is a high frequency driver.

27. The earphone of claim 24 wherein the rear portion of each of the first and second drivers further opens to a respective audio input port formed in a same side of the first and second drivers as the vent hole.

28. The earphone of claim 24 wherein a chamber is directly connected to each of the first and second drivers and surrounds the respective driver sound output ports.

29. The earphone of claim 24 wherein the internal air path is not open to the atmosphere.

30. The earphone of claim 24 wherein the first and second drivers are essentially identical and are connected to be operated in parallel.

* * * * *